United States Patent [19]

Johansson

[11] Patent Number: 4,501,108

[45] Date of Patent: Feb. 26, 1985

[54] METHOD OF SEALING A TUBULAR RECEPTACLE

[75] Inventor: Arne Johansson, Roskilde, Denmark

[73] Assignee: A/S Nunc, Roskilde, Denmark

[21] Appl. No.: 360,843

[22] Filed: Mar. 22, 1982

[30] Foreign Application Priority Data

Mar. 25, 1981 [DK] Denmark ..... 1352/81

[51] Int. Cl.[3] ..... B65B 53/02; B65B 63/08

[52] U.S. Cl. ..... 53/440; 53/442; 53/469

[58] Field of Search ..... 53/442, 469, 459, 440, 53/413

[56] References Cited

U.S. PATENT DOCUMENTS

| | | | |
|---|---|---|---|
| 2,174,924 | 10/1939 | McCleary | 53/440 X |
| 3,093,448 | 6/1963 | Kirkpatrick et al. | 53/442 X |
| 3,126,682 | 3/1964 | Krance | 53/442 |
| 3,187,477 | 6/1965 | Dreyfus | 53/442 |
| 3,190,050 | 6/1965 | Kirkpatrick | 53/442 X |
| 3,277,628 | 10/1966 | Harrison | 53/442 |
| 3,802,155 | 4/1974 | Thomas et al. | 53/442 X |
| 4,016,706 | 4/1977 | Braker et al. | 53/442 X |

FOREIGN PATENT DOCUMENTS

| | | | |
|---|---|---|---|
| 2820336 | 11/1978 | Fed. Rep. of Germany | 53/442 |

*Primary Examiner*—Horace M. Culver

*Attorney, Agent, or Firm*—Watson, Cole, Grindle & Watson

[57] ABSTRACT

A method of sealing a cryogenic tube comprising the steps of inserting the tube into a tubular body made from a heat-shrinkable material and having a length greater than that of the receptacle, heating the tubular body to a temperature sufficiently high to effect shrinkage of the tubular body and compressing the ends of the tubular body to cause the opposite tube walls to melt together to form an envelope completely surrounding the receptacle.

2 Claims, 2 Drawing Figures

METHOD OF SEALING A TUBULAR RECEPTACLE

BACKGROUND OF THE INVENTION

This invention relates to a method of sealing a tubular receptacle having a removable lid and containing a material, such as a sample of a biological material to be frozen.

When samples of biological materials contained in receptacles of the above-mentioned type are frozen to very low temperatures, e.g., by immersion of the receptacles into liquid nitrogen, a partial vacuum is created within the receptacles. This vacuum may cause liquid or gas, e.g., nitrogen, to leak into the receptacle, because the removable lid ordinarily does not fit sufficiently tight to the receptacle to prevent such leakage.

During thawing, the gas which has leaked into the receptacle tends to boil instantaneously, and this may cause the lid to be blown off or the receptacle to explode, with the result that the environment is contaminated with the sample and/or that the sample is lost. Therefore, it is essential that receptacles for low temperature storage can be sealed effectively.

It has been proposed to improve the sealing of receptacles for materials to be frozen by providing a gasket of silicon rubber in the zone in which the lid is attached to the receptacle. This proposal has not been successful because the silicon rubber gaskets become rigid and lose flexibility at the low temperatures, viz. down to −196° C., which occur when liquid nitrogen is used as freezing medium.

The object of the invention is to seal a receptacle of the above-mentioned type in a manner such that liquid or gas does not enter the receptacle during the freezing operation.

Another object is to provide a sealing method which can be utilized in connection with conventional receptacles having standard lids.

SUMMARY OF THE INVENTION

These objects and other objects which will appear from the following description are achieved by the method of the invention which comprises the steps of inserting the receptacle into a tubular body made from a heat-shrinkable material and having a length which is greater than that of the receptacle, heating the tubular body to a temperature which is sufficiently high to cause the heat-shrinkable material to shrink and compressing the ends of the tubular body to cause the opposite tube walls to melt together.

The receptacles thus sealed are totally surrounded by the heat-shrink material, which effectively prevents penetration of liquid or gas into the receptacle even at temperatures of the order of −200° C.

In a preferred embodiment of the invention a plurality of receptacles are inserted into the same tubular body before it is heated to effect a heat-shrinkage. The string of sealed receptacles thus formed constitutes a unit which is easy to handle during the immersion of the receptacles into a liquid freezing medium.

In one aspect of this embodiment the tubular body is compressed in the zones between adjacent receptacles inserted in the tubular body, thus confining each receptacle in its own envelope.

By providing a sufficiently broad compression zone between adjacent receptacles the string of receptacles can easily be cut into individual separately sealed receptacles, e.g., by a knife or a pair of scissors.

Furthermore, the provision of compression zones between the adjacent receptacles reduces the buoyancy of the string of sealed receptacles, thus facilitating its immersion into a liquid freezing medium.

The heat-shrinkable tubular body used in the method of the invention may be of any commercially availabe type. A preferred type is a polyethylene tube which has been cross-linked by irradiation, e.g., by ionizing radiation, and which has been expanded by compressed air to attain an expanded shape. The tubular body thus formed has a "memory" of its original shape and this "memory" is released when it is heated, thus making it heat-shrinkable.

Examples of receptacles which may be sealed by the method of the invention are cryogenic tubes made from a plastic material, such as polypropylene, and having a screw cap. However, also receptacles made from other materials, such as glass receptacles and receptacles having other lids, are suitable.

DESCRIPTION OF THE PREFERRED EMBODIMENTS

Figure 1:
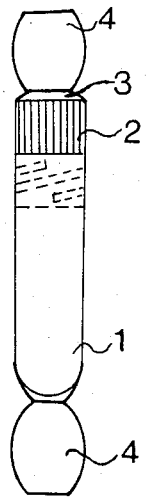
FIG. 1 illustrates a sealed receptacle obtained by the method of the invention.

FIG. 1 shows a tubular receptacle 1, e.g., a cryogenic tube made from polypropylene, a screw cap 2 screwed onto the tube 1.

As will appear from FIG. 1, the tube 1 is surrounded by a heat-shrinkable tubular body 3 having flat zones 4 (cf. also FIG. 2) at the ends of the receptacle. Thus, the receptacles is confined in a tightly fitting liquid- and gas-tight envelope.

The sealed receptacle has been obtained as follows:

The cryogenic tube 1 is filled with the material to be frozen and the cap 2 is screwed onto the tube 1. The tube 1 is then inserted into a tubular body 3 of heat-shrinkable material and is heated to a sufficiently high temperature to release its heat-shrinking properties. At the same time the free ends of the tubular body 3 are compressed to form the flat zones 4.

Figure 2:
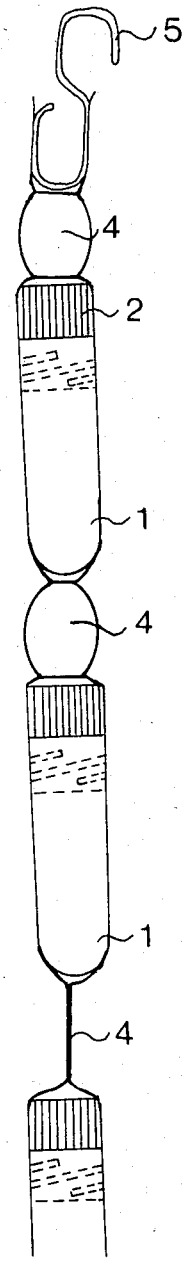
FIG. 2 illustrates a string of separately sealed receptacles.

FIG. 2 shows a string of sealed cryogenic tubes 1, each having a cap 2 and each being surrounded by a heat-shrink tubular body 3 which forms air- and gas-tight flat zones 4 in the spaces between adjacent tubes 1.

The string of receptacles illustrated also comprises a hook 5 inserted in the free end of the tubular body 3 and serving to suspend the string of sealed receptacles in a liquid freezing medium.

I claim:

1. A method of freezing a sample of a biological material comprising introducing said sample into a cylindrical container made from a plastic material and having a removable lid; inserting said container in a preformed tubular body made from a heat-shrinkable material, said tubular body having a length greater than that of the cylindrical container; heating the tubular body to a temperature sufficiently high to cause the heat-shrinkable material thereof to shrink; compressing the tubular body in zones adjacent to the ends of the container to cause the tubular body to melt together in said zones; and inserting the sealed container thus obtained in a freezing liquid.

2. A method of freezing a plurality of samples of biological material comprising respectively introducing said plurality of samples into a plurality of cylindrical containers, each container being made from a plastic material and having a removable lid; inserting said plurality of containers in spaced apart fashion in a preformed tubular body made from a heat-shrinkable material, said tubular body having a length sufficient to extend beyond the first and last of the containers located therein; heating the tubular body to a temperature sufficiently high to cause the heat-shrinkable material thereof to shrink; compressing the tubular body in zones adjacent to the ends of said plurality of containers therein to cause the tubular body to melt together in said zones; and inserting the sealed container thus obtained in a freezing liquid.

* * * * *